US010637173B2

(12) United States Patent
Hanke et al.

(10) Patent No.: US 10,637,173 B2
(45) Date of Patent: Apr. 28, 2020

(54) APPARATUS FOR ESTABLISHING AN ELECTRICALLY CONDUCTIVE CONNECTION

(71) Applicant: GENTHERM GMBH, Odelzhausen (DE)

(72) Inventors: Simon Hanke, Straubing (DE); Felix Brunner, München (DE); Markus Ißler, Gersthofen (DE)

(73) Assignee: GENTHERM GMBH, Odelzhausen (DE)

( * ) Notice: Subject to any disclaimer, the term of this patent is extended or adjusted under 35 U.S.C. 154(b) by 0 days.

(21) Appl. No.: 16/310,115

(22) PCT Filed: Jun. 6, 2017

(86) PCT No.: PCT/DE2017/000148
§ 371 (c)(1),
(2) Date: Dec. 14, 2018

(87) PCT Pub. No.: WO2017/215689
PCT Pub. Date: Dec. 21, 2017

(65) Prior Publication Data

US 2019/0181578 A1 Jun. 13, 2019

(30) Foreign Application Priority Data

Jun. 17, 2016 (DE) ..... 10 2016 007 347
Nov. 28, 2016 (DE) ..... 10 2016 014 096

(51) Int. Cl.
*H01R 13/28* (2006.01)
*H01R 13/193* (2006.01)
(Continued)

(52) U.S. Cl.
CPC ..... *H01R 13/193* (2013.01); *H01R 13/213* (2013.01); *H01R 13/22* (2013.01);
(Continued)

(58) Field of Classification Search
CPC ..... H01R 13/193; H01R 13/28; H01R 13/22; H01R 13/213; H01R 13/631; H01R 13/405
(Continued)

(56) References Cited

U.S. PATENT DOCUMENTS 1,144,225 A * 6/1915 Mills ..... H01R 13/28 439/292
3,091,746 A * 5/1963 Winkler ..... H01R 13/28 439/295
(Continued)

FOREIGN PATENT DOCUMENTS

DE 2348895 A1 4/1974
DE 10 2010 033374 B4 2/2012
(Continued)

OTHER PUBLICATIONS

International Search Report for Application No. PCT/DE2017/000148 dated Sep. 12, 2017.
(Continued)

*Primary Examiner* — Hien D Vu
(74) *Attorney, Agent, or Firm* — The Dobrusin Law Firm, P.C.

(57) ABSTRACT

An apparatus (2) for establishing an electrically conductive connection is disclosed. The apparatus (2) comprises at least one first electrical conductor element (4), which has a first contact pole (4'). In addition, the apparatus (2) comprises at least one second electrical conductor element (6), which has a second contact pole (6'). The at least one first electrical conductor element (4) is surrounded in at least some areas by a first electrically insulating casing element (8), by means of which the first contact pole (4') of the at least one first conductor element (4) is accommodated and/or held. The at least one second electrical conductor element (6) is also surrounded in at least some areas by a second electrically
(Continued)

insulating casing element (12), by means of which the second contact pole (6') of the at least one second conductor element (6) is accommodated and/or held. The second electrically insulating casing element (12) has a second recess (14) in the area of the second contact pole (6') of the at least one second electrical conductor element (6). The apparatus also comprises at least one securing means (26), which can be guided through the first recess (10) and the second recess (14), or which at least partially surrounds the first recess (10) and the second recess (14) at the side, to releasably couple the first electrically insulating casing element (8) and the second electrically insulating casing element (12) to one another in order to establish an electrical connection between the first contact pole (4') of the at least one first conductor element (4) and the second contact pole (6') of the at least one second conductor element (6).

20 Claims, 7 Drawing Sheets

(51) Int. Cl.

| | |
|---|---|
| ***H01R 13/213*** | (2006.01) |
| ***H01R 13/22*** | (2006.01) |
| ***H01R 13/631*** | (2006.01) |
| ***H01R 24/84*** | (2011.01) |
| ***H01R 13/405*** | (2006.01) |

(52) U.S. Cl.
CPC ..... *H01R 13/28* (2013.01); *H01R 13/405* (2013.01); *H01R 13/631* (2013.01); *H01R 24/84* (2013.01); *H01R 2201/26* (2013.01)

(58) Field of Classification Search
USPC ..... 439/290, 262, 294, 259
See application file for complete search history.

(56) References Cited

U.S. PATENT DOCUMENTS

| | | | | |
|---|---|---|---|---|
| 3,786,394 | A * | 1/1974 | Koenig | H02G 5/007 439/213 |
| 3,800,064 | A | 3/1974 | Lusk | |
| 3,941,446 | A | 3/1976 | Cantwell | |
| 4,166,663 | A * | 9/1979 | Walker | G01V 1/201 439/271 |
| 4,737,118 | A * | 4/1988 | Lockard | H01R 12/68 439/295 |
| 5,431,578 | A * | 7/1995 | Wayne | H01R 13/193 439/259 |
| 7,448,887 | B2 * | 11/2008 | Ikeya | H01R 13/621 439/157 |
| 8,608,498 | B2 * | 12/2013 | Suzuki | H01R 13/193 439/262 |
| 8,911,248 | B1 * | 12/2014 | Wildstone | H01R 4/60 307/65 |
| 10,218,111 | B2 * | 2/2019 | Schuttler | A61N 1/375 |
| 2004/0005823 | A1 | 1/2004 | An | |

FOREIGN PATENT DOCUMENTS

| | | | |
|---|---|---|---|
| EP | 2600467 | A1 | 6/2013 |
| EP | 2624366 | A1 | 8/2013 |
| JP | 62124779 | U | 9/1987 |
| JP | 2917823 | B2 | 3/1996 |
| JP | H11-351480 | A | 12/1999 |

OTHER PUBLICATIONS

Korean Notification of Refusal for Korean Application 10-2018-7037637, Dispatched dated Oct. 16, 2019.

* cited by examiner

APPARATUS FOR ESTABLISHING AN ELECTRICALLY CONDUCTIVE CONNECTION

The present invention relates to an apparatus for establishing an electrically conductive connection according to the features of the preamble of claim 1.

To be able to establish an electrically conductive connection between a first electrical conductor element and a second electrical conductor element, the respective contact poles of the first electrical conductor element and of the second electrical conductor element must be connected to one another. Secure coupling of the electrical conductor elements is important in particular in high-power connections in order to ensure adequate safety. Screw connections are generally used to do so, wherein, for example, screw elements are passed through recesses in the electrical conductor elements and then are secured tightly, for example, by means of a nut, so that the electrical conductor elements are pressed against one another. One advantage of screw connections is the possibility of transferring very high currents as well as the possibility of very secure and stable connections.

For example, DE 10 2010 033 374 B4 has already disclosed fastening, i.e., securing, of two electrical terminal face elements of a power module by means of a contacting screw element. The first terminal face element has a first surface feeder element while the second terminal face element is a second surface feeder element. The surface feeder elements overlap in an area provided for that purpose, and each has holes aligned axially with the others. A molded insulation part, which also has a hole, is provided between the surface feeder elements. A tube sleeve extends as a flat surface away from the edge of this hole. The tube sleeve extends through the hole of the first surface feeder element and into a hole in a carrier part, wherein a threaded sleeve having an inside thread for the contacting screw element is introduced. Furthermore, the contacting screw element has a screw head with a hexagonal recess.

However, one disadvantage of such an apparatus is that a special tool is required for attaching and/or fastening the screw connection, but it must also have suitable electrical insulation for preventing unwanted conduction of electricity to the tool. The insulation required for this is expensive for workshops, which must establish a connection of second electrical conductor elements in conjunction with assembly of vehicle batteries, for example. In particular the aforementioned expense and complexity are the result of the special training required for workers as well as the need for safety measures, which can lead to additional expenses for workshops. When assembling a screw connection, one must also monitor the torque in establishing the screw connection. It is hardly possible to ascertain from the outside whether a correct and/or appropriate torque has been selected to ensure safety in assembly, so that one must always monitor the torque during the assembly process.

In addition, there are already known devices, which allow a connection of two electrical conductor elements by means of a plug connection. In particular, such plug connections have proven to be particularly easy to handle. However, the electric loads to be transmitted through the electrical conductor elements are associated with very large installation spaces, so that the implementation and manufacture of these plug connections are possible only by complicated procedures, and furthermore, such plug connections are usually associated with a great expense.

Therefore, the object of the present invention is to provide an apparatus for establishing an electrically conductive connection, which will allow easy assembly without using special tools and/or assembly without using any tools at all. Furthermore, an inexpensive variant of a connection of at least two electrical conductor elements should be created in an acceptable size.

The above object is achieved by an apparatus for establishing an electrically conductive connection, comprising the features of patent claim 1. Additional advantageous embodiments are described by the dependent claims.

The invention thus proposes an apparatus for establishing an electrically conductive connection, comprising at least one first electrical conductor element, which has a first contact pole. In addition, the apparatus comprises at least one second electrical conductor element, which has a second contact hole. An electrically conductive connection can be formed in coupling the at least one first electrical conductor element and the at least one second electrical conductor element and/or the first contact pole and the second contact pole. The at least one first electrical conductor element may be in particular a connection for electricity.

The at least one first electrical conductor element is surrounded in at least some regions by a first electrically insulating casing element, by means of which the first contact pole of the at least one first electrical conductor element is accommodated and/or held. The material of the first electrically insulating casing element may be an electrically insulating plastic, for example.

The at least one first electrical conductor element may preferably be injected into the material of the first electrically insulating casing element. In this way, the first electrically insulating casing element can provide a touch-preventing sleeve for the at least one first electrical conductor element. In addition, the first electrically insulating casing element has a first recess in the area of the first contact pole of the at least one first electrical conductor element. An upper portion and a lower portion of the first electrically insulating casing element may be formed by the first recess of the first electrically insulating casing element. The first recess may be designed so that the at least one first electrical conductor element is partially surrounded by the lower portion of the first electrically insulating casing element, and the first contact pole of the at least one first electrical conductor element is partially exposed. The first recess in the first electrically insulating casing element may also be positioned so that only a type of upper protrusion in the material of the electrically insulating casing element is formed, said upper protrusion partially surrounding the at least one first electrical conductor element.

The at least one second electrical conductor element is also surrounded by a second electrically insulating casing element in at least some areas by means of which the second contact pole of the at least one second conductor element is received and/or held. The material of the first electrically insulating casing element may be, for example, an electrically insulating plastic.

The at least one second electrical conductor element can preferably injected into the material of the second electrically insulating casing element. The second electrically insulating casing element may form a touch protection sleeve for the at least one second electrical conductor element. The second electrically insulating casing element has a second recess in the area of the second contact pole of the at least one second electrical conductor element. An upper portion and a lower portion of the second electrically insulating casing element are formed by the second recess of the second electrically insulating casing element. The second recess is preferably designed so that the at least one second electrical conductor element is partially surrounded by the upper portion of the second electrically insulating casing element, and the second contact pole of the at least one second electrical conductor element is partially exposed. Likewise, however, the second recess of the second electrically insulating casing element may be positioned in such a way that only a lower protrusion of the material of the electrically insulating casing element is formed, said lower protrusion partially surrounding the at least one second electrical conductor element.

The apparatus also comprises at least one securing element which can be guided through the first recess and the second recess or which is at least partially surrounded by the first recess and the second recess on the side in order to establish an electrical connection between the first contact pole of the at least one first conductor element and the second contact pole of the at least one second conductor element, in order to releasably couple the first electrically insulating casing element and the second electrically insulating casing element to one another.

In the embodiment of the upper protrusion of the first electrically insulating casing element and a lower protrusion of the second electrically insulating casing element, the first electrically insulating casing element and the second electrically insulating casing element may optionally be joined together and secured by means of the securing means in such a way that an electrically conducting connection can be formed between the first contact pole of the at least one first electrical conductor element and the second contact pole of the at least one second electrical conductor element.

In a preferred variant of an embodiment of the apparatus according to the invention, the second recess of the second electrically insulating casing element is formed so that the lower portion of the first electrically insulating casing element can be introduced into the second recess of the second electrically insulating casing element. Likewise the first recess in the first electrically insulating casing element is preferably designed so that the upper portion of the second electrically insulating casing element can be introduced into the first recess of the first electrically insulating casing element. A first contact face of the first contact pole can be formed by the partially exposed first contact pole in the lower portion of the first electrically insulating casing element, and a second contact face of the second contact pole may be formed by the second contact pole in the upper portion of the second electrically insulating casing element which is preferably partially exposed [the second contact pole is partially exposed].

For example, by introducing the lower portion of the first electrically insulating casing element into the second recess of the second electrically insulating casing element and introducing the upper portion of the second electrically insulating casing element into the first recess in the first electrically insulating casing element, a form-fitting connection can be established between the first contact pole of the at least one first electrical conductor element and the second contact pole of the at least one second electrical conductor element and/or the first contact face of the first contact pole and the second contact face of the second contact pole. Due to these recesses, it is possible to form a contact plug, which allows a simple joining and/or separation of the first contact pole of the at least one first electrical conductor element and the second contact pole of the at least one second electrical conductor element.

In addition, the first electrically insulating casing element may have a first recess which penetrates completely through the upper portion of the first electrically insulating casing element. Furthermore, the at least one first electrical conductor element may have a second recess which penetrates completely or at least partially through the at least one first electrical conductor element. The first electrically insulating casing element may optionally have a third recess which penetrates at least partially through the lower portion of the first electrically insulating casing element. The third recess in the first electrically insulating casing element may thus be provided in particular when the second recess penetrates completely through the at least one first electrical conductor element. The first recess and the second recess are preferably arranged so they are aligned with one another. The third recess that is optionally provided may be arranged so that it is aligned with the first recess and with the second recess. The first, second and optional third recess are designed to be at least approximately circular.

The second electrically insulating casing element may also have a fourth recess which completely penetrates through the upper portion of the second electrically insulating casing element. In addition, the at least one second electrical conductor element may have a fifth recess which completely penetrates through the at least one second electrical conductor element. The fourth recess and the fifth recess are also preferably arranged so that they are aligned with one another and are also preferably designed to be at least approximately circular. However, it is also conceivable for the recesses to be designed in another shape, for example, in an oval shape. Likewise, the design of the first, second, third, fourth and/or fifth recess(es) with the same or (partially) different diameters is also possible.

The preferably circular recesses are preferably positioned so that the first recess of the first electrically insulating casing element and the second recess of the at least one first electrical conductor element and the fourth recess of the second electrically insulating casing element as well as the fifth recess of the at least one second electrical conductor element are arranged so that they are aligned with one another in a coupled position of the first electrically insulating casing element and the second electrically insulating casing element and/or the first contact pole of the at least one first electrical conductor element and the second contact pole of the at least one second electrical conductor element.

It is possible in this way to enable the securing element to be brought at least partially through the first, second, third, fourth and/or fifth recess(es), so that stationary securing of the first electrically insulating casing element and the second electrically insulating casing element and/or the first compact pole of the at least one first electrical conductor element and of the second contact pole of the at least one second electrical conductor element may be formed. For optimal joining of the first contact pole of the at least one first electrical conductor element and the second contact pole of the at least one second electrical conductor element, the preferably circular recesses may be arranged in such a way as to yield a preferably vertical orientation of the securing means with respect to the at least one first electrical conductor element and the at least one second electrical conductor element. Due to this type of securing, it is possible to ensure that the first contact face of the first contact pole, which is provided by the at least one first electrical conductor element, and the second contact face of the second contact pole, which is provided by the at least one second electrical conductor element, are in secure and/or surface contact with one another.

The securing means is preferably designed as a plug element and said plug element may have at least one pin. The at least one pin of the plug element can be guided at least partially through the recesses that are arranged so that they are aligned with one another. In particular it is possible to provide that the at least one pin can be locked in a position in which it is guided at least partially into the preferably circular recesses in the area of the first, second, third, fourth and/or fifth recess(es) but preferably in the area of the second recess in the at least one first electrical conductor element.

This locking of the at least one pin may be accomplished, for example, by means of a rotation of the plug element and/or of the at least one pin. To do so the plug element may have a screw head. The design with a screw head and/or with a thread facilitates in particular the handing and/or a rotational movement of the plug element and/or the at least one pin. The rotational position of the at least one pin may change relative to its longitudinal axis by means of a rotation of the screw head. Thus, for example, a corresponding rotation and/or locking of the plug element or of the at least one pin may be accomplished by means of a rotation of the screw head, preferably by at least approximately 360°, 180° or 90°. Due to the locking, a displacement of the plug element and/or of the at least one pin in the axial direction is prevented and thereby a secure contacting of the first contact pole of the at least one first electrical conductor element and of the second contact pole of the at least one second electrical conductor element is made available. In particular an unintentional rotation of the plug element about its own longitudinal axis can be prevented by the locking of the plug element and/or of the at least one pin. Thus, for example, it may be possible to loosen the plug element and/or the at least one pin only by applying a greater force. For example, a torque at least 50% greater than the torque required for rotation when in an unlocked condition, but preferably 100%, may be used for rotation of the plug element and/or of the at least one pin.

For locking the plug element and/or the at least one pin, the plug element and/or the at least one pin may have a locking device, preferably in the form of a hook or a cross-pin. With a rotation of the plug element and/or of the screw head, the hook or the cross-pin may engage, catch and/or be snapped in a recess or an undercut in a device component that is provided, for example, and thereby secure the plug element and/or the at least one pin to prevent axial displacement. The recess or the undercut is preferably provided in the area of the second preferably circular recess in the at least one first electrical conductor element and/or in the area of the third preferably circular recess optionally provided in the first electrically insulating casing element. However, an arrangement of the recess or the undercut in another device component is also conceivable. The plug element may thus optionally also have a recess or an undercut in which a locking device, preferably in the form of a hook or a cross-pin may engage, catch and/or snap, said locking device optionally being provided in particular in the area of the first electrically insulating casing element and/or the second electrically insulating casing element. It is thus also conceivable, for example, for the first electrically insulating casing element to have a locking device which can engage, catch and/or snap into a recess or an undercut in the second electrically insulating jacket element. In these ways a certain prestress can also develop between the first and second contact faces of the first and second contact poles.

It has proven to be particularly advantageous if the recess or the undercut is arranged with an angle of pitch being coiled around the axis of the plug element and/or of the at least one pin in at least some areas. In this way, a movement of the plug element and/or the at least one pin in the axial direction can be induced by rotation of the plug element and/or the at least one pin. A contact pressure between the first contact pole of the at least one first electrical conductor element and the second contact pole of the at least one second electrical conductor element of at least one 1 $N/m^2$, at least 10 $N/m^2$ or also at least 100 $N/m^2$ can preferably be created by means of rotation of the plug element and/or of the at least one pin about 360°.

A so-called bayonet closure can be formed by means of such a design of the recess and/or the undercut in a device component as well as the arrangement of the hook and/or the cross-pin of the locking device, preferably the plug closure. Instead of the arrangement of a recess or an undercut in one of the device components, it is also conceivable to use a bayonet sleeve which can be placed in a position provided with respect to a device component. The bayonet sleeve may optionally already be formed by injection in the device component provided for this purpose.

In addition, the plug element may have a tension element by means of which tension element the first contact pole of the at least one first electrical conductor element and the second contact pole of the at least one second electrical conductor element can be put under tension with one another in at least some areas. For example, the tension element may be designed in the form of a plate spring which is arranged in an area beneath the screw head which is optionally present. In this way tension on the plate spring is possible as soon as the plate spring sits on a surface of the first electrically insulating casing element and the locking device engages in the recess and/or in the undercut in one of the device components. When using such a bayonet closure, it is not necessary to monitor the torque in rotation of the plug element.

Another embodiment variant of the device for establishing an electrically conductive connection provides for a securing means surrounding the first recess and the second recess in the first and second electrically insulating casing elements at least partially on the side in order to establish an electrical connection between the first contact pole and the second contact pole, wherein the first electrically insulating casing element and the second electrically insulating casing element are releasably coupled to one another. To do so, the securing element is designed as a clamp element which completely covers at least one side face of the coupled casing elements in portions in the vertical direction in coupling of the first insulating casing element and the second insulating casing element. To establish a constant tension between the coupled casing elements, the clamp ends are situated on the surface of the upper portion of the first insulating casing element and on the surface of the lower portion of the second insulating casing element. The first and second electrically insulating casing elements are at least partially surrounded by the clamp element in a certain manner. The clamp element may preferably be designed in a U shape. The clamp ends of the clamp element, which rest on the surfaces of the upper portion of the first insulating casing element and on the surface of the lower portion of the second insulating casing element, may be equipped with tension elements to intensify the clamping connection between the casing elements. In this embodiment, no recesses are necessary in the first and second electrically insulating casing elements or in the first and second electrical conductor elements.

In one embodiment variant of the apparatus according to the invention, the at least one first electrical conductor element is designed as at least an approximately flat metal element, at least in an area of the first contact face of the first contact pole and the second contact pole, and the at least one second electrical conductor element is designed the same at least in an area of the second contact face of the second contact pole and of the first contact pole. In this regard, it is also conceivable for the at least one first electrical conductor element to be designed as a profiled metal element, at least in an area of the first contact face of the first contact pole and of the second contact pole, and for the at least one second electrical conductor element to be designed as a profiled metal element at least in an area of the second contact face of the second contact pole and of the first contact pole. In particular a toothed profiling of metal elements has proven advantageous. The teeth of the toothed profiling of the first contact pole here and the teeth of the toothed metal element of the second contact pole may intermesh to thereby form suitable contact faces. The toothed profiling permits an increase in the surface area of the first and second contact poles. This can result in a large current transfer area as well as enough cooling surface area for dissipation of heat into the conductor elements. Furthermore, it is possible to establish a mechanical stabilization of the connection of the first contact pole of the at least one first electrical conductor element and of the second contact pole of the at least one second electrical conductor element.

According to a preferred embodiment of the apparatus for connecting at least one first electrical conductor element and at least one second electrical conductor element, the apparatus is a high-power connector. For example, a (high-voltage) battery element may be provided, said battery element comprising an apparatus according to the invention or a plurality of apparatuses according to the invention for connecting at least one first electrical conductor element and at least one second electrical conductor element according to the embodiment variants described above. The aforementioned (high-voltage) battery element may be an automotive battery element. For example, individual elementary cells may be connected to one another in a battery by means of a high-power connector according to the invention. It is also conceivable to use a high-power connector according to the invention for connecting a battery to external electrical components such as an alternator for a vehicle, for example, a charging station or an electrical consumer. The apparatus according to the invention is preferably used for connecting at least one first electrical conductor element and at least one second electrical conductor element or the battery element according to the invention in automobiles.

Embodiments of the invention and the advantages thereof are explained in greater detail below on the basis of the accompanying figures. The size ratios of the individual elements to one another in the figures do not always correspond to the real size ratios because some shapes have been simplified and other shapes are illustrated in enlarged diagrams in relation to the other elements for the sake of better illustration.

Figure 4A:
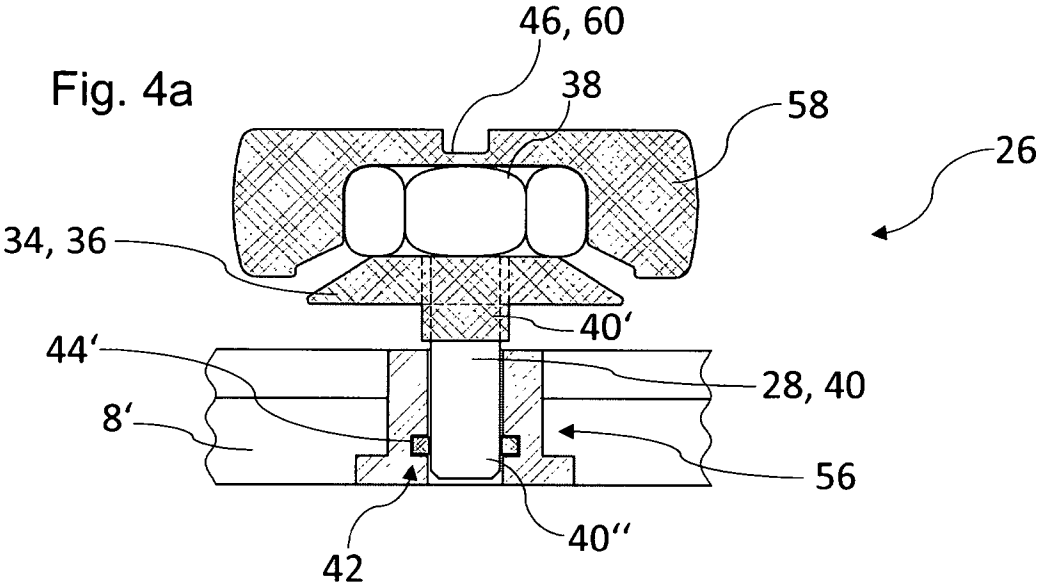
Figure 4B:
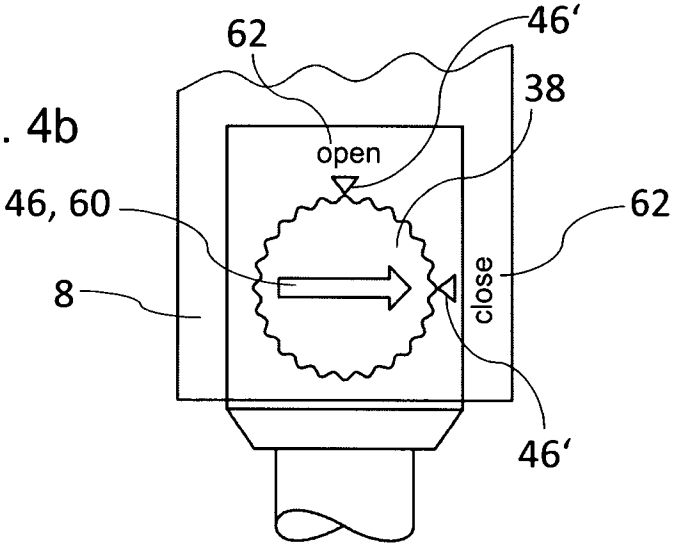
Figure 5:
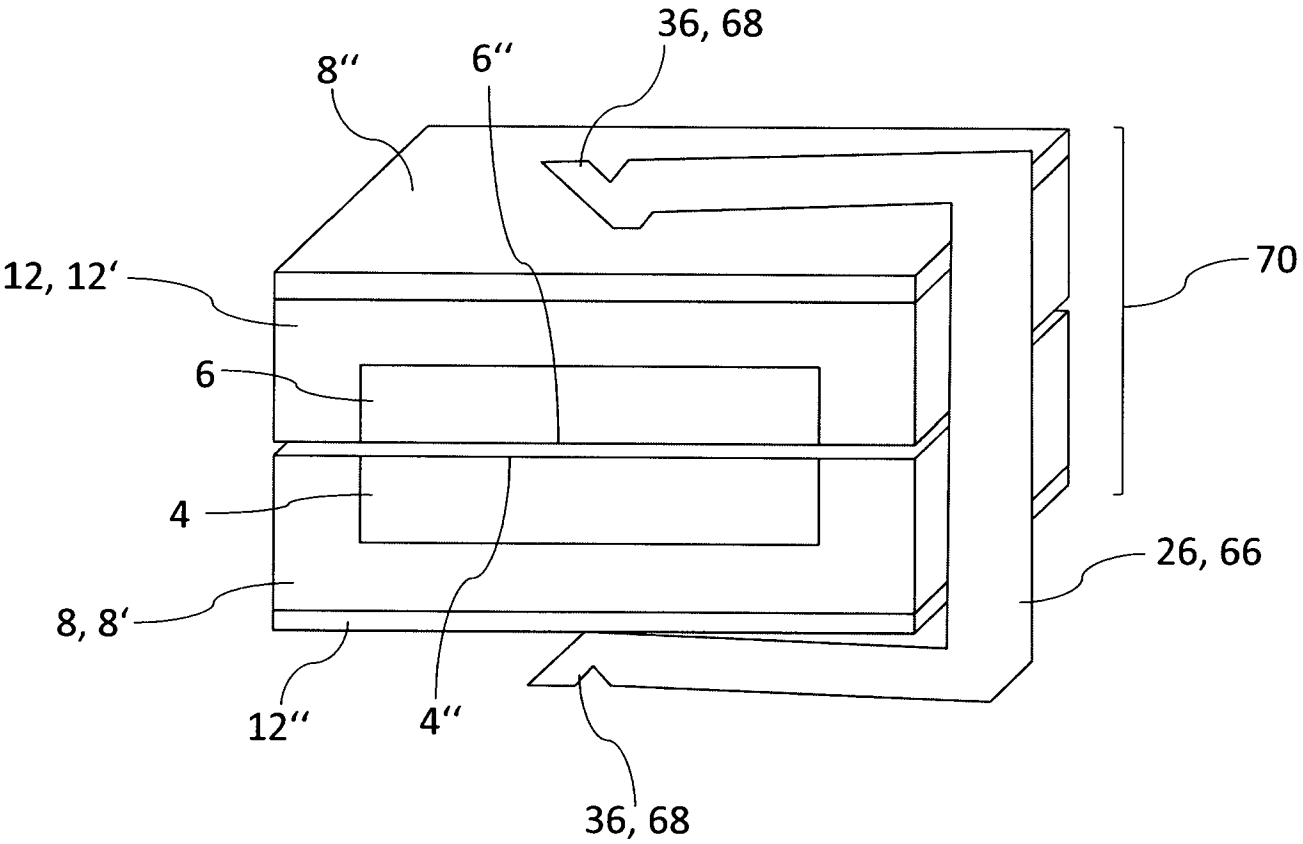
Figure 6A:
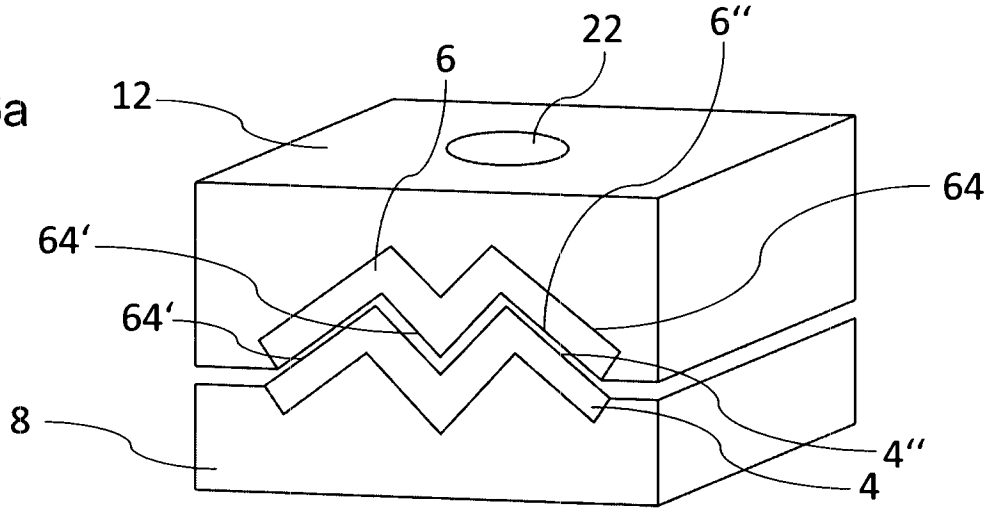
Figure 6B:
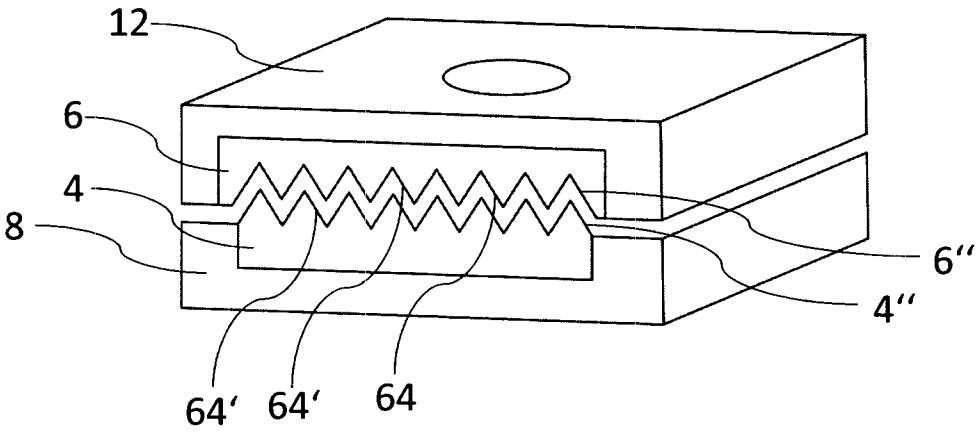
Figure 7:
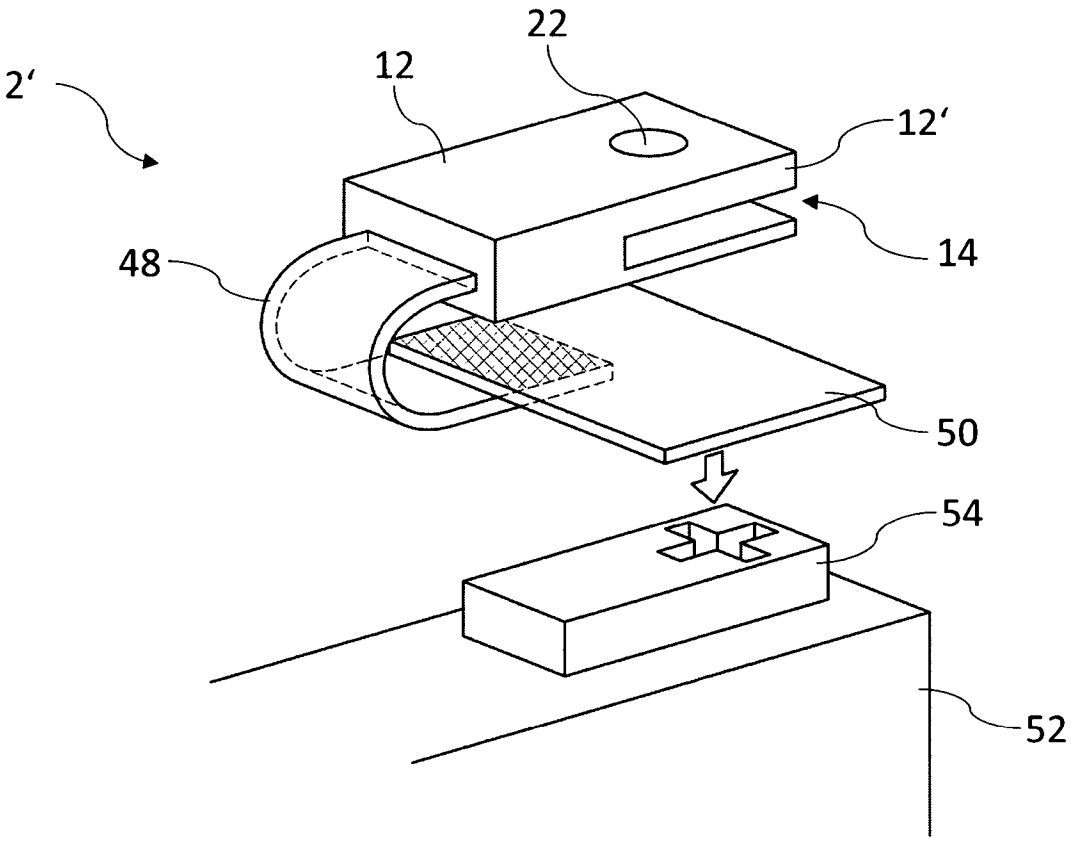

FIGS. 4*a* and 4*b* each show a schematic view of a plug element such as that which can be provided with various embodiments of an apparatus according to the invention;

FIG. 5 shows another embodiment of an apparatus according to the invention for connecting at least one first electrical conductor element and one second electrical conductor element;

FIGS. 6*a* and 6*b* each show a schematic view of a conductor element configuration, such as that which may be provided with various embodiments of an apparatus according to the invention;

FIG. 7 shows a schematic view of a preferred application variant of the apparatus according to the invention.

For the same elements or those having the same effect as those according to the invention, identical reference numerals are used. Furthermore, for the sake of simplicity, reference numerals are shown in the individual figures only when they are necessary for the description of the respective figure. The embodiments illustrated represent only examples of how the apparatus according to the invention may be designed and they do not constitute a conclusive delineation.

Figure 1:
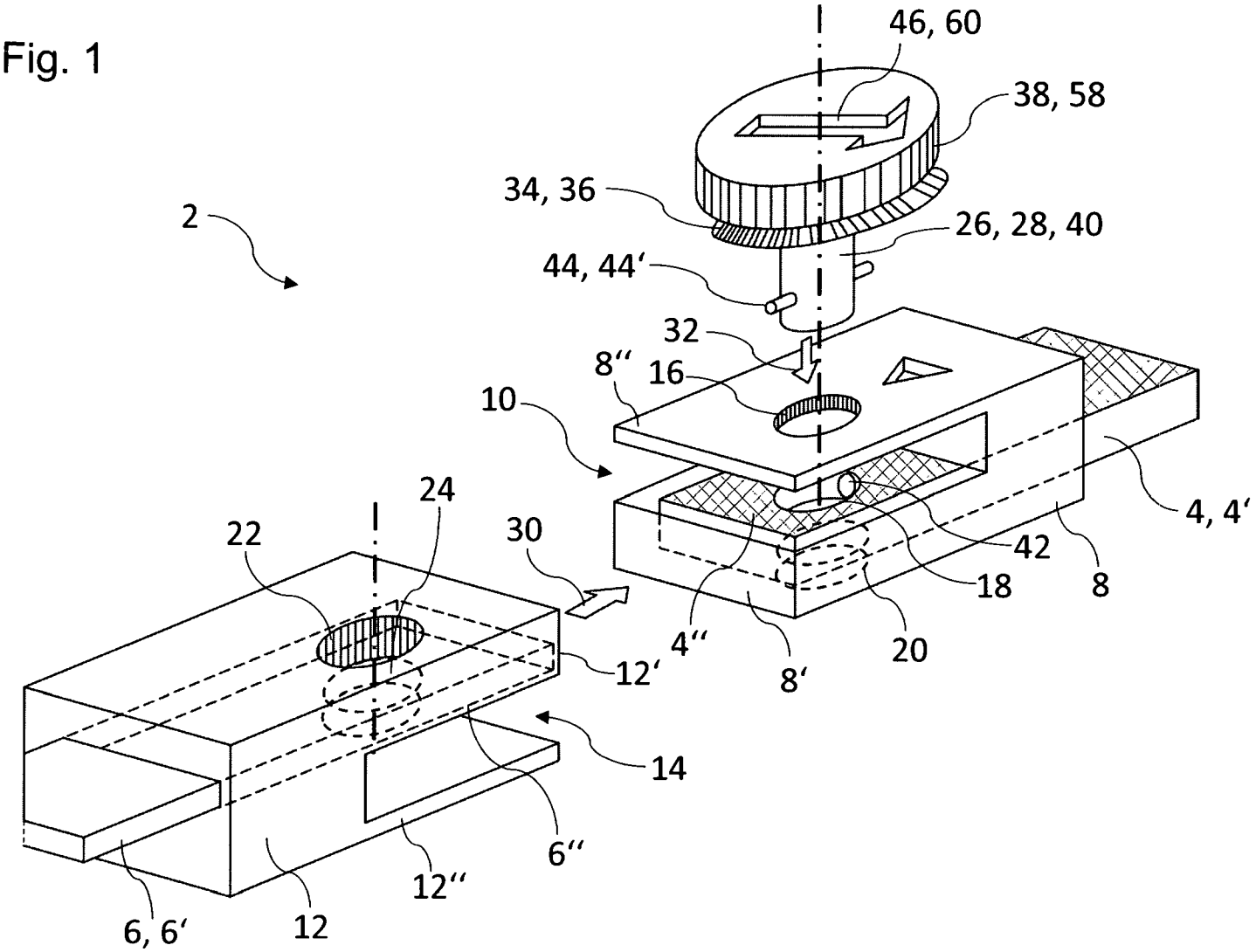
FIG. 1 shows a schematic view of one embodiment of an apparatus according to the invention for connecting at least one first electrical conductor element and one second electrical conductor element.

FIG. 1 shows a preferred embodiment variant of an apparatus 2 according to the invention for establishing an electrically conductive connection between at least one first electrical conductor element 4 and at least one second electrical conductor element 6. The apparatus 2 preferably comprises a first electrical conductor element 4 and a second electrical conductor element 6. The first electrical conductor element 4 has a first contact pole 4', and the second electrical conductor element 6 has a second contact pole 6'. The first contact pole 4' of the first electrical conductor element 4 and the second contact pole 6' of the second electrical conductor element 6 may be brought into electrically conductive contact. To do so the first component 4' of the first electrical conductor element 4 has a first contact face 4", and the second contact pole 6' of the second electrical conductor element 6 has a second contact face 6". For example, the first electrical conductor element 4 and the second electrical conductor element 6 may each be designed as a metal plate or sheet metal which is designed to be flat in the area of the first contact pole 4' and/or the second contact pole 6', but profiling 6 of the metal plate or of the sheet metal of the first contact pole 4' and of the second contact pole 6' is also conceivable, as shown in FIGS. 6*a* and *b*.

The first electrical conductor element 4 is accommodated by a first electrically insulating casing element 8 and/or is held by a first electrically insulating casing element 8. In the area of the first contact pole 4', in particular in the area of the first contact face 4", however, the first casing element 8 has a first recess 10. An upper portion 8" and a lower portion 8' of the first electrically insulating casing element 8 may be formed by the first recess 10 of the first electrically insulating casing element 8. The first recess 10 is designed so that the first electrical conductor element 4 is partially surrounded by the lower portion 8' of the first electrically insulating casing element 8, and the first contact pole 4' and/or the first contact face 4" of the first electrical conductor element 4 is partially exposed.

The second conductor element 6 is also partially accommodated by a second electrically insulating casing element 12 and/or is held by a second electrically insulating casing element 12 which has a second recess 14 in the area of the second contact pole 6', in particular in the area of the second contact face 6". An upper portion 12' and a lower portion 12" of the second electrically insulating casing element 12 are formed by the second recess 14 in the second electrically insulating casing element 12. The second recess 14 is also designed so that the second electrical conductor element 6 is partially surrounded by the upper portion 12' of the second electrically insulating casing element 12, and the second contact pole 6' and/or the second contact face 6" of the second electrical conductor element 6 is/are partially exposed.

The first recess 10 and the second electrically insulating casing element 12 are designed so that the upper portion 12' of the second electrically insulating casing element 12 can accommodated in the first recess. Likewise the second recess 14 and the first electrically insulating casing element 8 are designed so that the lower portion 8' of the first electrically insulating casing element 8 can be accommodated in the second recess 14. The first recess 10 and the upper portion 12' of the second electrically insulating casing element 12 are preferably designed so that they correspond to one another such that the upper portion 12' of the second electrically insulating casing element 12 can be accommodated with an accurate fit in the first recess 10. Likewise the second recess 14 and the lower portion 8' of the first electrically insulating casing element 8 are designed so that they correspond to one another such that the lower portion 8' of the first electrically insulating casing element 8 can be accommodated with an accurate fit in the second recess 14. In this way the first electrically insulating casing element 8 and the second electrically insulating casing element 12 can be pushed into one another (cf. arrow 30), so that the first contact pole 4' of the first electrical conductor element 4 and the second contact pole 6' of the second electrical conductor element 6 are in electrically conducting contact in the area of the first contact face 4" and the second contact face 6".

In addition, the first electrically insulating casing element 8 has a first circular recess 16 in the upper portion 8", and the first conductor element 4 has a second circular recess 18. The first circular recess 16 penetrates completely through an upper portion 8" of the first electrically insulating casing element 8. The second circular recess 18 in the first electrical conductor element 4 can also penetrate through it completely. It is appropriate here if the lower portion 8' of the first electrically insulating casing element 8 also has a third circular recess 20. The third circular recess 20 may penetrate completely or just partially through the lower portion 8'. In addition, it is conceivable for the second circular recess 18 not to completely penetrate the first electrical conductor element 4. A third circular recess 20 is not necessary here. The circular recesses 16, 18 and 20 are each arranged so that they are aligned with one another.

The second electrically insulating casing element 12 has a fourth circular recess 22 which completely penetrates the upper portion 12' of the second electrically insulating casing element 12. The second electrical conductor element 6 also comprises a fifth circular recess 24 which preferably penetrates completely through the second electrical conductor element 6. The circular recesses 22 and 24 are each arranged, so that they are aligned with one another. Another circular recess may optionally also be provided in the lower portion 12" of the second electrically insulating casing element 12. On the whole, the circular recesses 16, 18 and 20 and/or 22 and 24 are arranged in such a way that the circular recesses 16, 18, 20, 22 and 24 are aligned with one another when the upper portion 12' of the second electrically insulating casing element 12 is preferably accommodated completely in the first recess 10 and/or when the lower portion 8' of the first electrically insulating casing element 8 is preferably accommodated completely in the second recess 14.

To be able to brace the first casing element 8 with the first electrical conductor element 4 and the second casing element 12 with the second electrical conductor element 6 and/or the first contact pole 4' of the first electrical conductor element 4 and the second contact pole 6' of the second electrical conductor element 6 to one another, a securing means 26 is provided. The securing means 26 is guided through the first recess 10 in the first electrically insulating casing element 8 and the second recess 14 in the second electrically insulating casing element 12 in order to releasably couple the first electrically insulating casing element 8 and the second electrically insulating casing element 12 to one another to establish an electrical connection between the first contact pole 4' and the second contact pole 6'.

To do so, the securing means 26 is introduced into the circular recesses 16, 18, 20, 22 and 24, as illustrated by the arrow 32. The securing means 26 is designed as a plug element 28. The plug element 28 has a pin 40. The pin 40 has certain dimensions so that it can preferably extend at least into the area of the second circular recess 18.

The plug element 28 and/or the pin 40 can be locked by means of a rotational movement. To facilitate the rotational movement, the plug element 28 has a screw head 38. The material of the screw head 38 is an electrically insulating material. Furthermore, an additional insulation layer 58 is provided on the screw head 38 as shown in FIG. 4*a* in particular. The plug element 28 and/or the pin 40 can be locked in place by rotation of the screw head 38 and/or the plug element 28 by 90°, 180° or 360° about the longitudinal axis of the pin 40. In particular, it is provided here that the plug element 28 cannot be moved and/or displaced further in the axial direction because of being locked after the plug element 28 and/or the pin 40 has been rotated. To be able to release the tension of the contact poles 4' and 6', it is necessary to rotate the screw head 38 and/or the plug element 28 in the opposite direction. Rotation in the opposite direction is possible here only with a certain application of force such as a certain torque, which is at least 50% greater or even 100% greater than the torque required for rotation in the unlocked condition.

In addition, the pin 40 has a locking device, for example, in the form of a hook 44 or a cross-pin 44' inserted at a right angle through the pin 40. The hook 44 is introduced into a recess 42 or an undercut which may be arranged in the area of the third circular recess 20, but preferably in the area of the second circular recess 18. The recess 42 and/or the undercut may also extend from the second circular recess 18 to the third circular recess 20. By rotation of the plug element 28 and/or the pin 40, the hook 44 engages in the recess 42 so that the plug element 28 and/or the pin 40 can reach its locking position and an axial displacement of the plug element 28 and/or the pin 40 is prevented. To do so, the recess 42 may also have a hook-shaped groove into which the hook 44 and/or the cross-pin 44' can engage. Alternatively or additionally, it is possible to provide that the pin 40 has a recess in which a locking device of a locking component can be accommodated. The recess 42 may have a curved shape. The recess 42 is preferably provided in at least some areas with an angle of pitch, which winds around the longitudinal axis of the plug element 28 and/or the pin 40. In this way, the plug element 28 and/or the pin 40 can be forced to move in the axial direction by relative rotation of the plug element 28 and/or the pin 40 around the longitudinal axis. For example, a contact pressure, which may amount to at least 1 $N/m^2$, at least 10 $N/m^2$ or at least 100 $N/m^2$, can be generated between the first contact face 4" of the first contact pole 4' and the second contact face 6" of the second contact pole 6' by means of rotation by an angle of max. 360°. A so-called bayonet closure 56 may be formed in this way, said bayonet closure 56 optionally being used to implement a connection of the securing means 26 and the first casing element 8 and/or the first conductor element 4 that can be established rapidly and/or released rapidly.

To secure the first conductor element 4 and the second conductor element 6 and/or the first contact pole 4' and the second contact pole 6' and/or to be able to brace them further with one another, the plug element 28 and/or the pin 40 also has an additional tension element 34. By means of the tension element 34, it is possible to ensure that the first contact face 4" of the first contact pole 4' and the second contact face 6" of the second contact pole 6' are pressed against one another in at least some areas, so as to result in a secured electrically conductive connection. The tension element 34 may be designed in the form of a spring element 36, for example. The spring element 36 may be a plate spring, for example, which is preferably arranged in an area beneath the screw head 38. The spring element 36 here is stretched as soon as the spring element 36 is in contact with the first electrically insulating casing element 8, and the locking device 44, 44' engages in the recess 42 and/or the undercut due to a rotational movement of the plug element 28 and/or the pin 40.

Figure 2:
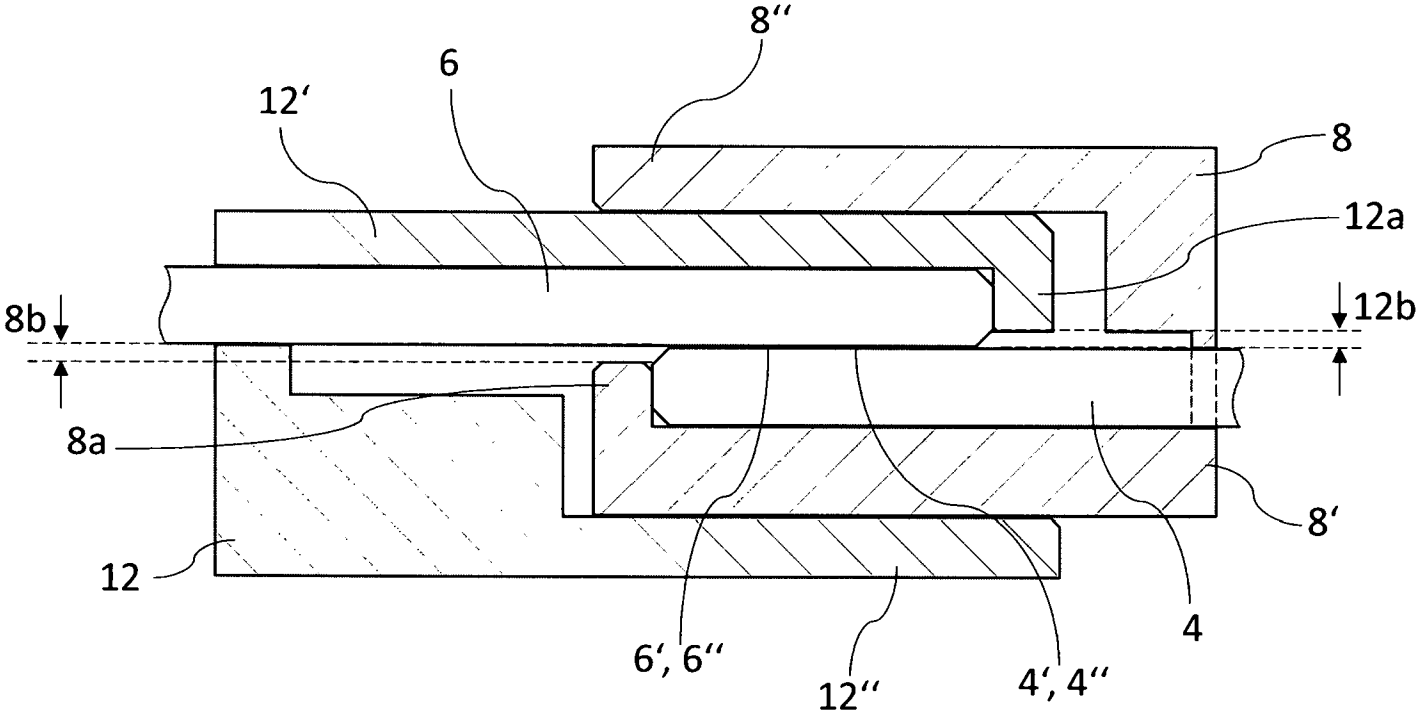
FIG. 2 shows a schematic view of one embodiment of a coupled first conductor element and second electrical conductor element.

FIG. 2 shows a detailed view of contact poles 4' and 6' of the conductor elements 4 and 6 that are coupled together and/or casing elements 8 and 12 that are coupled together in an embodiment of the apparatus 2 according to the invention according to the invention. It can be seen here clearly how the lower portion 8' of the first electrically insulating casing element 8 is accommodated in the second recess 14 in the second electrically insulating casing element 12 and/or how the upper portion 12' of the second electrically insulating casing element 12 is accommodated in the first recess 10 in the first electrically insulating casing element 8. As already described, the first electrical conductor element 4 is arranged in the lower portion 8' of the first electrically insulating casing element 8 so that the first contact face 4" of the first contact pole 4' is exposed through the recess 10 (cf. FIG. 1). The second electrical conductor element 6 is also arranged in the upper portion 12' of the second electrically insulating casing element 12 such that the second contact face 6" of the second contact pole 6' is exposed. The first electrical conductor element 4 protrudes to a certain extent out of the lower portion 8' of the first electrically insulating casing element 8 so as to result in a distance **8*b* between the material 8*a* of the first electrically insulating casing element 8 and the second contact face 6" of the second electrical conductor element 6. The situation may also be similar for the second electrically insulating casing element 12 so that a distance 12*b* results between the material 12*a* of the second electrically insulating casing element 12 and the first contact face 4" of the first electrical conductor element 4. In this way it is possible to ensure that the first contact pole 4' and the second contact pole 6' are securely in contact with one another in the areas of the first contact face 4" and of the second contact face 6", so that a constant electrical connection can be maintained. This prevents such a disturbance in the electrically conducting connection because of protruding material 8*a* and/or 12*a* of the electrically insulating casing elements 8 and 12**.

Figure 3:
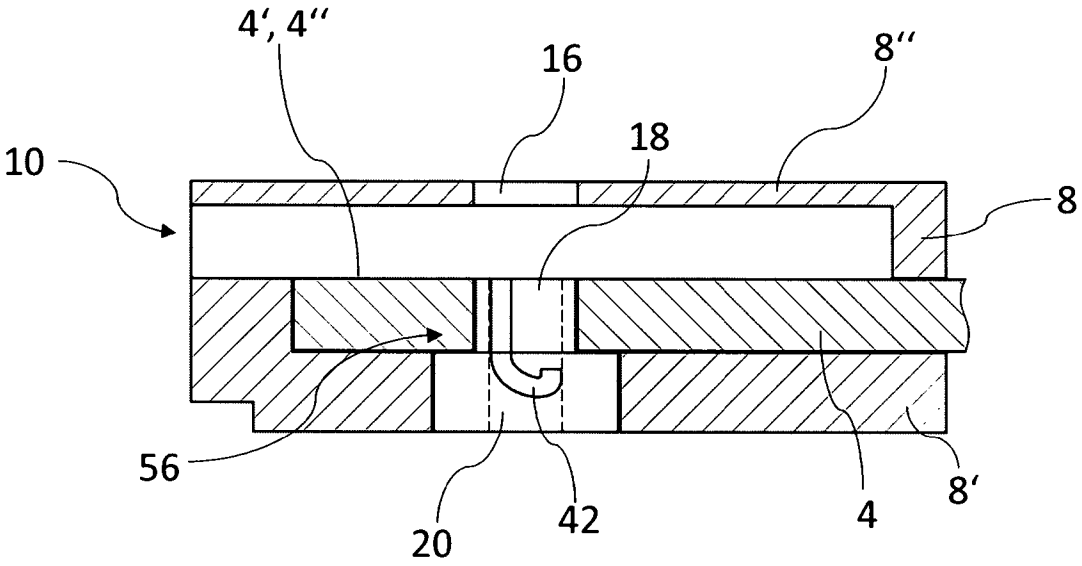
FIG. 3 shows a schematic detailed view of one embodiment of the apparatus according to the invention.

FIG. 3 shows a detailed view of a locking device in the form of a bayonet closure 56 for the securing means 26. A portion of the first electrically insulating casing element 8 is illustrated here. The first conductor element 4 is accommodated by the first electrically insulating casing element 8. The hook 44 and/or the cross-pin 44' can pass partially through the third circular recess 20 and can be inserted into the recess 42 which is designed with a curve by rotation of the plug element 28 and/or the screw head 38. The pin 40 of the plug element 28 has a dimension such that the hook 44 and/or the cross-pin 44' which is preferably arranged in an end area of the pin 40 may extend into the third circular recess 20 of the lower portion 8' of the first electrically insulating casing element 8 and thus passes through the first circular recess 16 of the first electrically insulating casing element 8 as well as the second circular recess 18 in the first electrical conductor element 4. The second circular recess 18 and the third circular recess 20 may have the same or different diameters.

FIG. **4*a* illustrates a securing means 26 according to the invention. The securing means 26 is designed as a plug element 28, which has a pin 40. A screw head 38 is arranged at the upper end 40' of the pin 40 in order to simplify a rotational movement of the plug element 28 and/or of the pin 40. In addition, the screw head 38 has an additional insulation layer 58. An arrow symbol 46 is shown in the screw head 38 and/or in the insulation layer 58, as shown in FIG. 4*b*. The arrow symbol 46 provides an orientation aid to facilitate assembly of the securing element 26. Thus, for example, positioning arrows 46' or the inscription "open" and/or "closed" 62, for example, may be illustrated on the surface of the first casing element 8, identifying a sufficient or necessary rotational movement for securing the plug element 28. At the same time, a notch 60 is created in the surface of the insulation layer 58 by means of an arrow symbol 46, which is created with depth. A point of application for an aid for rotation of the plug element 28 such as a point of application for a screwdriver is formed by the notch 60**.

In addition, the plug element 28 also has a cross-pin 44' passing through the pin 40 at a right angle in the area of the lower end 40" of the pin 40. Alternatively instead of the cross-pin 44', a hook 44 may also be provided. The cross-pin 44' engages in the recess 42 on rotation of the plug element 28, said recess preferably being provided with an angle of pitch in at least some areas. To further tighten the first and second electrical conductor elements 4, 6 and/or the first and second contact poles 4', 6', a tension element 34 is arranged in the area of the upper end 40' of the plug element 28 and/or of the pin 40, but beneath the screw head 38. The tension element 34 is preferably a plate spring 36. As soon as the plug element 28 has been rotated into the recess 42 by a rotational movement due to an action involving the cross-pin 44', tightening of the plate spring 36, which then rests on the surface of the first casing element 8, may then take place. With another rotational movement of the plug element 28 and/or of the pin 40, the plate spring 39 is additionally braced.

Another embodiment variant of the apparatus according to the invention for connecting at least one first electrical conductor element 4 and one second electrical conductor element 6 is illustrated in FIG. 5. The apparatus 2 here also comprises a first electrical conductor element 4 and a second electrical conductor element 6. The first electrical conductor element 4 has a first contact pole 4', and the second electrical conductor element 6 has a second contact pole 6'. The first contact pole 4' of the first electrical conductor element 4 and the second contact pole 6' of the second electrical conductor element 6 should be brought into electrical contact with one another at the first contact face 4" and the second contact face 6".

As in the embodiment variant in FIG. 1, here again, the first casing element 8 and the second casing element 12 can be pushed into one another because of the first and second recesses 10 and 14, so that an electrically conductive connection can be established as the first and second contact faces 4" and 6" of the first and second electrical conductor elements 4 and 6. To be able to brace the first and second casing elements 8 and 12 and/or the first and second contact faces 4" and 6" together, a securing means 26 is required. The securing means 26 here is designed as a clamp element 66 having approximately a U shape. In coupling the first insulating casing element 8 and the second insulating casing element 12, the clamp element 66 covers at least one side face 70 completely in some areas in the vertical direction. Clamp ends 68 of the clamp element 66 may be in contact with the surface of the other portion 8" of the first insulating casing element 8 and the surface of the lower portion 12" of the second insulating casing element 12, so that the first and second contact faces 4" and 6" can be pressed against one another. To improve the pressing, the clamp ends 68 may additionally be equipped with tension elements 36.

FIGS. 6*a* and 6*b* each show differently designed profilings 64 of the respective contact faces 4" and 6" of the first contact pole 4' and the second contact pole 6'. In particular tooth-shaped profilings 64 have proven to be especially advantageous. The profiling 64 in FIG. 6*a* has a few teeth 64' but the profiling in FIG. 6*b* has a greater number of teeth. The teeth 64' of the tooth-shaped profiling 64 of the first contact face 4" are designed so that they can mesh with the teeth 64' of the tooth-shaped profiling 64 of the second contact face 6". An increase in surface area of the first and second contact poles 4', 6' is possible due to the tooth-shaped profiling 64, so that a large current transfer area can be formed as well as a sufficient cooling surface for dissipation of heat. The connection of the contact poles 4, 6 can also be stabilized mechanically.

FIG. 7 shows a preferred application variant of the apparatus 2 according to the invention. The apparatus 2 is used as a so-called high-power connector 2'. The second electrically insulating casing element 12 and/or the second electrical conductor element 6 can be attached to an aluminum plate 50 by means of a copper strip 48. The aluminum sheet 50 can be coupled to a cell terminal 54 of a battery element, for example, in the form of a lithium cell 52. This provides a simple connection of the high-power connector 2' to a lithium cell 52, so that said high-power connector 2' can establish an electrical connection of the lithium cell 52 to a current source.

LIST OF REFERENCE NUMERALS

2 apparatus for establishing an electrically conductive connection
2' high-power connector
4 first electrical conductor element
4' first contact pole
4" first contact face
6 second electrical conductor element
6' second contact pole
6" second contact face
8 first electrically insulating casing element
8' lower portion of the first casing element
8" upper portion of the first casing element
8*a* material of the first electrically insulating casing element
8*b* distance between the material of the first electrically insulating casing element and the second contact face of the second electrical conductor element
10 first recess
12 second electrically insulating casing element
12' upper portion of the second casing element
12" lower portion of the second casing element
12*a* material of the second electrically insulating casing element
12*b* distance between the material of the second electrically insulating casing element and the first contact face of the first electrical conductor element
14 second recess
16 first circular recess
18 second circular recess
20 third circular recess
22 fourth circular recess
24 fifth circular recess
26 securing means
28 plug element
30 arrow
32 arrow
34 tension elements
36 spring element, plate spring
38 screw head
40 pin
40' upper end of the pin
40" lower end of the pin
42 recess
44 hook
44' cross-pin
46 arrow symbol
46' positioning arrows
48 copper strip
50 aluminum sheet
52 lithium cell
54 cell terminal
56 bayonet closure
58 insulation layer
60 notch
62 writing
64 profiling
64' teeth
66 clamp element
68 spring clamp ends
70 side face

The invention claimed is:

1. An electrical apparatus for establishing an electrically conductive connection, comprising:

a first electrical conductor element, having a first contact pole, a second electrical conductor element, having a second contact pole, a first electrically insulating casing element, the first electrically insulating casing element has a C-shaped cross section that includes a first recess defined between a first upper portion and a first lower portion, the first electrical conductor element is located in the first lower portion of the first recess, a second electrically insulating casing element, the second electrically insulating casing element has a second recess defined between a second upper portion and a second lower portion, the second electrical conductor element is located in the second upper portion of the second recess, and a securing means that is guided through both of the first recess and the second recess to releasably couple the first electrically insulating casing element and the second electrically insulating casing element to one another.

2. The electrical apparatus according to claim 1, wherein the first lower portion of the first electrically insulating casing element is received into the second recess in the second electrically insulating casing element, and the second upper portion of the second electrically insulating casing element is received into the first recess in the first electrically insulating casing element.

3. The electrical apparatus according to claim 1, wherein the first upper portion of the first electrically insulating casing element has a first upper aperture, and the first electrical conductor element has a first conductor aperture, wherein the first upper aperture and the first conductor aperture are aligned with one another.

4. The electrical apparatus according to claim 3, wherein the first electrical conductor and/or the first lower portion of the first electrically insulating casing element comprises a first locking recess, and wherein the securing means comprises a pin configured to engage the first locking recess.

5. The electrical apparatus according to claim 4, wherein the first locking recess is centered about an axis that is different than an axis about which the first upper aperture is centered about.

6. The electrical apparatus according to claim 4, wherein the second electrical conductor and/or the second lower portion of the second electrically insulating casing element comprises a second locking recess, and wherein the securing means comprises a pin configured to engage the second locking recess.

7. The electrical apparatus according to claim 2, wherein the first lower portion of the first electrically insulating casing element has a first lower aperture that is aligned with the first upper aperture and the first conductor aperture.

8. The electrical apparatus according to claim 7, wherein, the second upper portion comprises a second upper aperture, wherein the first upper aperture, the first conductor aperture, the first lower aperture, the second upper aperture, and the second conductor aperture are aligned with one another in a coupled position of the first electrically insulating casing element and of the second electrically insulating casing element.

9. The electrical apparatus according to claim 8, wherein, the second lower portion comprises a second lower aperture, wherein the first upper aperture, the first conductor aperture, the first lower aperture, the second upper aperture, the second conductor aperture, and the second lower aperture are aligned with one another in a coupled position of the first electrically insulating casing element and of the second electrically insulating casing element.

10. The electrical apparatus according to claim 3, wherein the second upper portion of the second electrically insulating casing element has a second upper aperture, and the second electrical conductor element has a second conductor aperture, wherein the second upper aperture and the second conductor aperture are aligned with one another.

11. The electrical apparatus according to claim 10, wherein the first upper aperture in the first electrically insulating casing element, the first conductor aperture in the first electrical conductor element, the second upper aperture in the second electrically insulating casing element, and the second conductor aperture in the second electrical conductor element are aligned with one another in a coupled position of the first electrically insulating casing element and of the second electrically insulating casing element.

12. The electrical apparatus according to claim 10, wherein the securing means can be passed at least partially through the first upper aperture, the first conductor aperture, the second upper aperture, and the second conductor aperture.

13. The electrical apparatus according to claim 12, wherein the securing means is a plug element having a pin, which can be passed at least partially through the first upper aperture, the first conductor aperture, the second upper aperture, and the second conductor aperture.

14. The electrical apparatus according to claim 13, wherein the plug element has a locking device that includes a hook or a cross-pin, which can engage, catch and/or be snapped with a recess or an undercut defined in an area of the first conductor aperture in the first electrical conductor element and/or in an area of a first lower aperture defined in the lower portion of the first electrically insulating casing element.

15. The electrical apparatus according to claim 14, wherein the locking device is a bayonet closure.

16. The electrical apparatus according to claim 14, wherein the plug element has a tension element configured to apply tension on the first contact pole of the first electrical conductor element and on the second contact pole of the second electrical conductor element.

17. An electrical assembly comprising:

the electrical apparatus according to claim 1, a plate electrically connected to the second electrical conductor, and a battery comprising a terminal, wherein the plate is configured to be electrically connected to the terminal of a battery.

18. An electrical apparatus for establishing an electrically conductive connection, comprising:

a first electrical conductor element, having a first contact pole, a second electrical conductor element, having a second contact pole, a first electrically insulating casing element, the first electrically insulating casing element has a C-shaped cross section that includes a first recess defined between a first uDDer portion and a first lower portion, the first electrical conductor element is located in the first lower portion of the first recess, a second electrically insulating casing element, the second electrically insulating casing element has a second recess defined between a second upper portion and a second lower portion, the second electrical conductor element is located in the second upper portion of the second recess, and a securing means that at least partially surrounds the first recess and the second recess to releasably couple the first electrically insulating casing element and the second electrically insulating casing element to one another, the securing means having a C-shape.

19. The electrical apparatus according to claim 18, wherein the securing means is a clamp element, which completely covers at least one side face in some areas in a vertical direction in coupling of the first insulating casing element and the second insulating casing element and clamp ends of the clamp element rest on the surface of the first upper portion of the first insulating casing element and on the surface of the second lower portion of the second insulating casing element.

20. The electrical apparatus according to claim 18, wherein the securing means comprise clamp ends having tension elements.

* * * * *